US010874155B2

(12) United States Patent
Schierenbeck et al.

(10) Patent No.: US 10,874,155 B2
(45) Date of Patent: Dec. 29, 2020

(54) PROTECTIVE CUFF WITH ANTI-WICKING, PARTICULATE, AND/OR FLUID ENTRY PROTECTION

(71) Applicant: Honeywell International Inc., Morris Plains, NJ (US)

(72) Inventors: Alan W. Schierenbeck, Dayton, OH (US); Josee Lalonde, St-Louis de Gonzague (CA); Lisa Cubas Ray, Kettering, OH (US)

(73) Assignee: Honeywell International Inc., Morris Plains, NJ (US)

( * ) Notice: Subject to any disclaimer, the term of this patent is extended or adjusted under 35 U.S.C. 154(b) by 161 days.

(21) Appl. No.: 15/927,624

(22) Filed: Mar. 21, 2018

(65) Prior Publication Data

US 2018/0289081 A1 Oct. 11, 2018

Related U.S. Application Data

(60) Provisional application No. 62/483,089, filed on Apr. 7, 2017.

(51) Int. Cl.

| | |
|---|---|
| ***A41D 31/00*** | (2019.01) |
| ***A41D 17/00*** | (2006.01) |
| ***A41D 31/04*** | (2019.01) |
| ***A41D 13/00*** | (2006.01) |
| ***A41D 27/10*** | (2006.01) |
| ***A41D 31/12*** | (2019.01) |
| *A41D 3/00* | (2006.01) |
| *A41D 1/06* | (2006.01) |

(52) U.S. Cl.

CPC ..... *A41D 31/04* (2019.02); *A41D 13/0002* (2013.01); *A41D 13/0005* (2013.01); *A41D 27/10* (2013.01); *A41D 31/12* (2019.02); *A41D 1/06* (2013.01); *A41D 3/00* (2013.01); *A41D 17/00* (2013.01); *A41D 2600/20* (2013.01)

(58) Field of Classification Search

CPC ..... A41D 13/0002; A41D 31/12; A41D 13/0005; A41D 27/10; A41D 1/06; A41D 31/02

See application file for complete search history.

(56) References Cited

U.S. PATENT DOCUMENTS 4,543,670 A * 10/1985 Ehring ..... A41D 27/10 2/124
4,768,233 A * 9/1988 Grilliot ..... A41D 13/005 2/81

(Continued)

*Primary Examiner* — Richale L Quinn
(74) *Attorney, Agent, or Firm* — Alston & Bird LLP

(57) ABSTRACT

A protective cuff is fixed in a pant leg or sleeve of a protective garment. The protective cuff includes a fluid/particulate/water dam fixed around an interior circumference of a pant leg or sleeve of a protective garment at an attachment location that is spaced upwardly from a lowermost hem of the pant leg or sleeve. The dam includes a resilient opening to surround and snuggly engage another wearable piece of protective equipment or a wearer's limb received in the opening. A length of loose material extends from the attachment location to the resilient opening to surround the wearable piece of protective equipment or the wearer's limb received in the opening. An anti-wicking guard extends from the lowermost hem to the attachment location and surrounding the interior of the pant leg or sleeve.

6 Claims, 6 Drawing Sheets

(56) References Cited

U.S. PATENT DOCUMENTS

| | | | | | |
|---|---|---|---|---|---|
| 5,073,988 | A * | 12/1991 | Lewis, Jr. | A41D 13/0005 | 2/123 |
| 5,208,919 | A * | 5/1993 | Fields | A41D 27/10 | 2/123 |
| 5,920,905 | A * | 7/1999 | Aldridge | A41D 31/085 | 2/81 |
| 6,665,880 | B2 * | 12/2003 | Poppe | A41D 13/1209 | 2/114 |
| 6,687,913 | B2 * | 2/2004 | Aldridge | A41D 27/04 | 2/272 |
| 7,155,746 | B2 * | 1/2007 | Schorr | A41D 13/1209 | 2/125 |
| 7,225,470 | B1 * | 6/2007 | Bradford | A41D 13/0005 | 2/2.11 |
| 7,921,471 | B2 * | 4/2011 | Mordecai | A62B 17/006 | 2/202 |
| 8,726,415 | B2 * | 5/2014 | Grilliot | A41D 13/0005 | 2/81 |

* cited by examiner

PROTECTIVE CUFF WITH ANTI-WICKING, PARTICULATE, AND/OR FLUID ENTRY PROTECTION

CROSS-REFERENCE TO RELATED APPLICATIONS

This application claims priority of Provisional Ser. No. 62/483,089, filed Apr. 7, 2017, the disclosure of which is hereby incorporated by reference in its entirety.

FEDERALLY SPONSORED RESEARCH OR DEVELOPMENT

Not Applicable.

MICROFICHE/COPYRIGHT REFERENCE

Not Applicable.

FIELD

This invention relates to personal protective equipment (PPE), and more particularly, to the junctures/interfaces between separate elements of personal protective equipment that are worn by a user, and in even more particular applications, to the interface/junctures between a collar and a hood, a sleeve and a protective glove, or a protective boot and a protective pant/liner combination that are worn by an emergency responder, such as a firefighter.

BACKGROUND

Many occupations require PPE that affords additional coverage beyond that provided by safety glasses and hard hats. These protective ensemble elements, such as, but not limited to, garments or jumpsuits, and other ancillary protective elements are worn to help reduce the impact of environmental conditions from direct exposure to the wearer. These potentially dangerous items, such as, but not limited to heat, cold, steam and hazardous chemicals/particulates can pose an immediate threat to the workers' health and safety, while other types of exposures such as, but not limited to, bio-pathogens, asbestos fibers and sub-acute exposures to carcinogenic Toxic Industrial Compounds (TICs) and Volatile Organic Compounds (VOCs) pose potential long term chronic health issues up to including death that do not appear until years or decades later.

In order to provide an ensemble comprised of stand-alone elements to deliver head-to-toe coordinated protection, the juncture at which these elements interface such as sleeve-to-glove and boot-to-pants are obvious points of concern for the entry of the fluid threats and/or air born threats discussed above. While there are commercially available designs for such protective element interface/juncture areas, there is a continuing need to provide improvements that reduce or eliminate ingress of fluid/air born contaminants, and/or reduce the cost or simplify the production of such protective elements, and/or simplify the selection of appropriate protective equipment by reducing the number of possible combinations/variations available for providing appropriate protection.

Further in this regard, one juncture of interest involves the interface/juncture between a protective pant/liner combination with a protective boot, such as turnout pants worn by firefighters. Conventionally, such interfaces can include the use of anti-wicking guards that serve to reduce or prevent the wicking of moisture into a thermal liner of the pant/liner combination and water dams that restrict the flow of water and other liquids upward between the protective boot and the pant/liner combination. Commercially available wicking guards and water dams are separate components that can either be used separately or in combination and are typically provided with several different variations of each component. Again, improvements over such currently available products can be made that reduce or eliminate ingress of fluid/airborne contaminants, and/or reduce the cost or simplify the production of anti-wicking guards and/or water dams, and/or simplify the selection of the appropriate protective equipment by providing appropriate protection without requiring a wearer to sort through several possible combinations or variations.

SUMMARY

In accordance with one feature of the invention, a protective cuff is fixed in a pant leg or sleeve of a protective garment. The protective cuff includes a fluid/particulate/water dam fixed around an interior circumference of a pant leg or sleeve of a protective garment at an attachment location that is spaced upwardly from a lowermost hem of the pant leg or sleeve. The dam includes a resilient opening to surround and snuggly engage another wearable piece of protective equipment or a wearer's limb received in the resilient opening. A length of loose material extends from the attachment location to the resilient opening to surround the wearable piece of protective equipment or the wearer's limb received in the opening. An anti-wicking guard extends from the lowermost hem to the attachment location and surrounds the interior of the pant leg or sleeve.

As one feature, the dam and the anti-wicking guard are formed by the same piece of material.

In one feature, the attachment location is at least 2 inches above the lowermost hem.

According to one feature, the length of loose material extends at least 2 inches from the attachment location to the resilient opening.

As one feature, the attachment location is about 3 inches above the lowermost hem and the length of loose material extends about 3 inches from the attachment location to the resilient opening.

In one feature, a protective cuff is fixed in a pant leg or sleeve of a protective garment. The protective cuff includes a fluid/particulate/water dam fixed around an interior circumference of a pant leg or sleeve of a protective garment at an attachment location that is spaced upwardly at least 2 inches from a lowermost hem of the pant leg or sleeve. The dam includes a resilient opening to surround and snuggly engage another wearable piece of protective equipment or a wearer's limb received in the opening. A length of loose material extends at least 2 inches from the attachment location to the resilient opening to surround the wearable piece of protective equipment or the wearer's limb received in the opening.

According to one feature, the attachment location is about 3 inches above the lowermost hem.

As one feature, the length of loose material extends about 3 inches from the attachment location to the resilient opening.

In one feature, an anti-wicking guard extends from the lowermost hem to the attachment location and surrounding the interior of the pant leg or sleeve.

According to one feature, the dam and the anti-wicking guard are formed by the same piece of material.

As one feature, the pant leg or sleeve is provided in the form of a liner having an outwardly facing moisture barrier and an inwardly facing thermal barrier, and the dam is fixed only to the thermal barrier at the attachment location.

In one feature, the anti-wicking guard includes a portion that extends upwardly between the water barrier and the thermal barrier at the lowermost hem.

Other features and advantages will become apparent from a review of the entire specification, including the appended claims and drawings.

DETAILED DESCRIPTION

Figure 1:
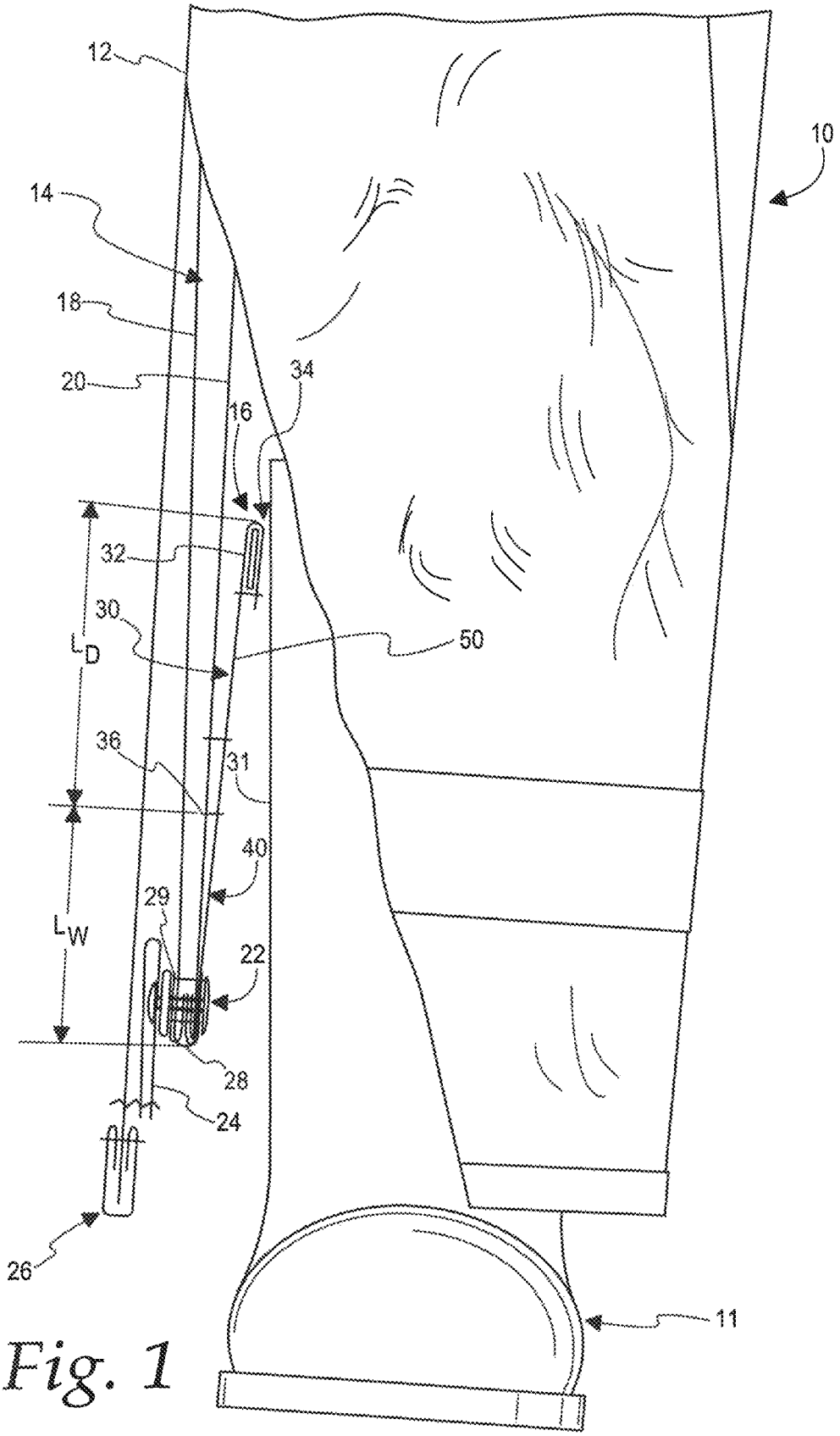
FIG. 1 is a somewhat diagrammatic illustration showing a protective boot and one leg of a protective turnout pant/liner combination, such as are worn by firefighters, with a portion of the pant/liner combination broken away for purposes of illustration to reveal an integrated protective cuff of the liner in an up position according to this disclosure.

With reference to FIG. 1, one leg of a pair of protective, firefighter turnout pant/liner combination 10 is shown together with a protective boot 11, with a portion of the pant/liner combination 10 cut away for purposes of illustration. The pant/liner combination 10 includes an outer shell 12 of any suitable construction and design, many of which are known, and a combined moisture barrier/thermal liner 14 including a protective cuff 16 that provides an anti-wicking guard and protection against particulate and/or fluid entry according to this disclosure. The liner 14 includes a moisture barrier 18 and a thermal barrier 20, both of which can be of any suitable design and materials, many of which are known and some of which have multiple layers of material forming the barrier 18 and/or 20. As is conventional, the liner 14 is attached to the outer shell 10 using a suitable fastener, such as a snap fastener 22, with one portion of the snap fastener 22 attached to a fabric tab 24 that extends upward from the hem/cuff 26 of the outer shell 12 and the other portion of the snap fastener 22 being fixed to the hem 28 of the liner 14 by a fabric tab 29. While the snap fastener 22 is shown in the illustrated embodiment, it should be understood that any suitable fastener, many of which are known, can be utilized between the liner 14 and the outer shell 12. Further details of the construction of the outer shell 12 and the liner 14 are not critical to an understanding of the protective cuff 16 disclosed herein and, accordingly such details will not be described further in this disclosure, with the exception of the details involving the connections between the protective cuff 16 and the barriers 18 and 20 of the liner 14.

Figure 2:
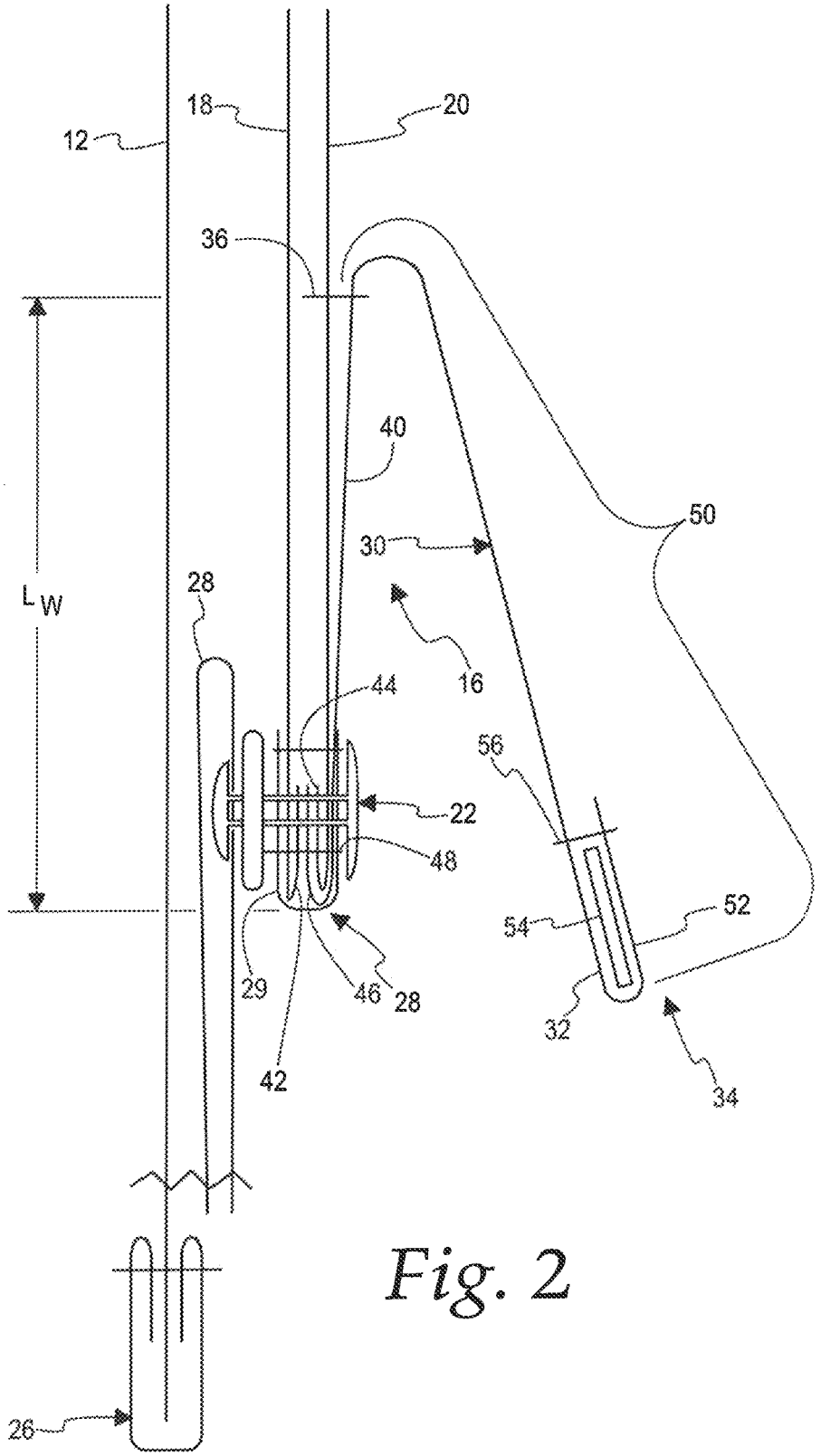
FIG. 2 is an enlarged view of the pant and liner of FIG. 1, but showing the protective cuff in a down position.
Figure 3:
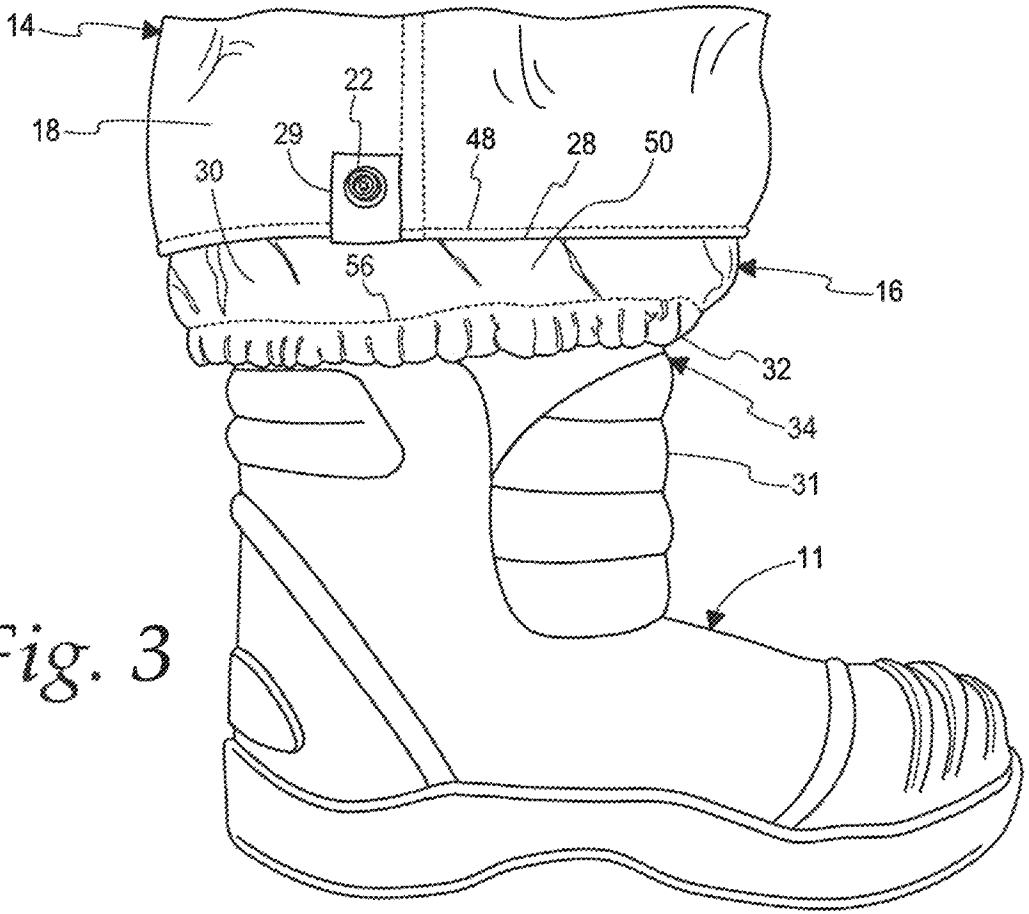
FIG. 3 is a view showing the liner and protective cuff of FIGS. 1 and 2, with the liner moved upward relative to the boot to reveal the cuff in the up position.
Figure 4:
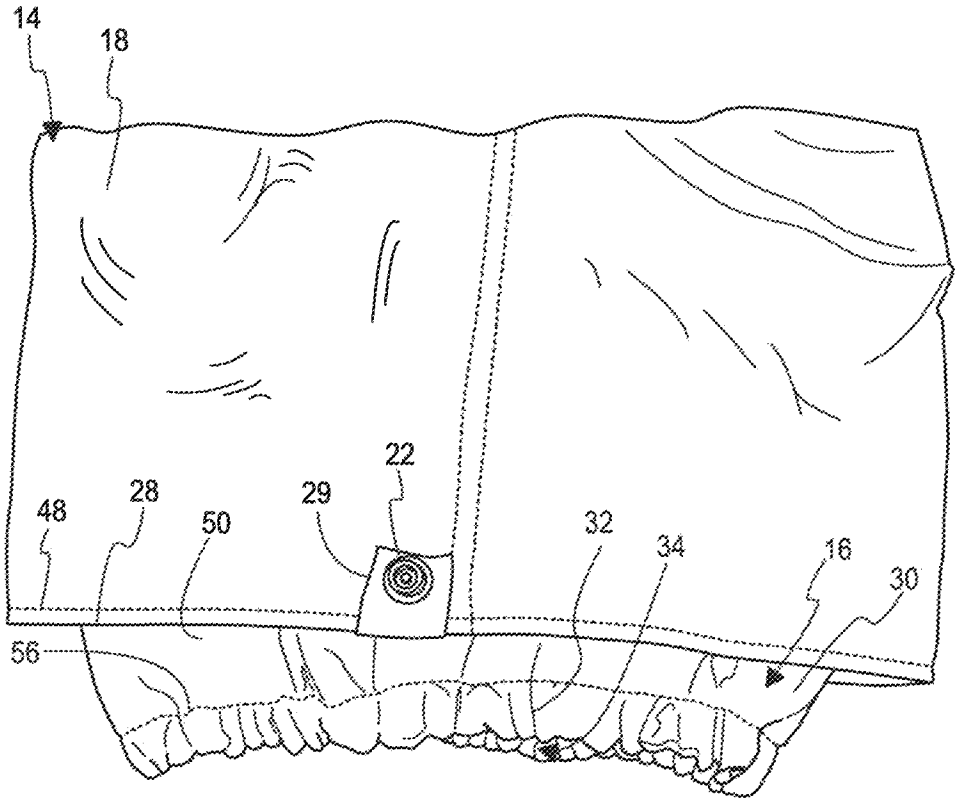
FIG. 4 is a view similar to FIG. 3, but showing the liner and cuff with the boot removed.
Figure 5:
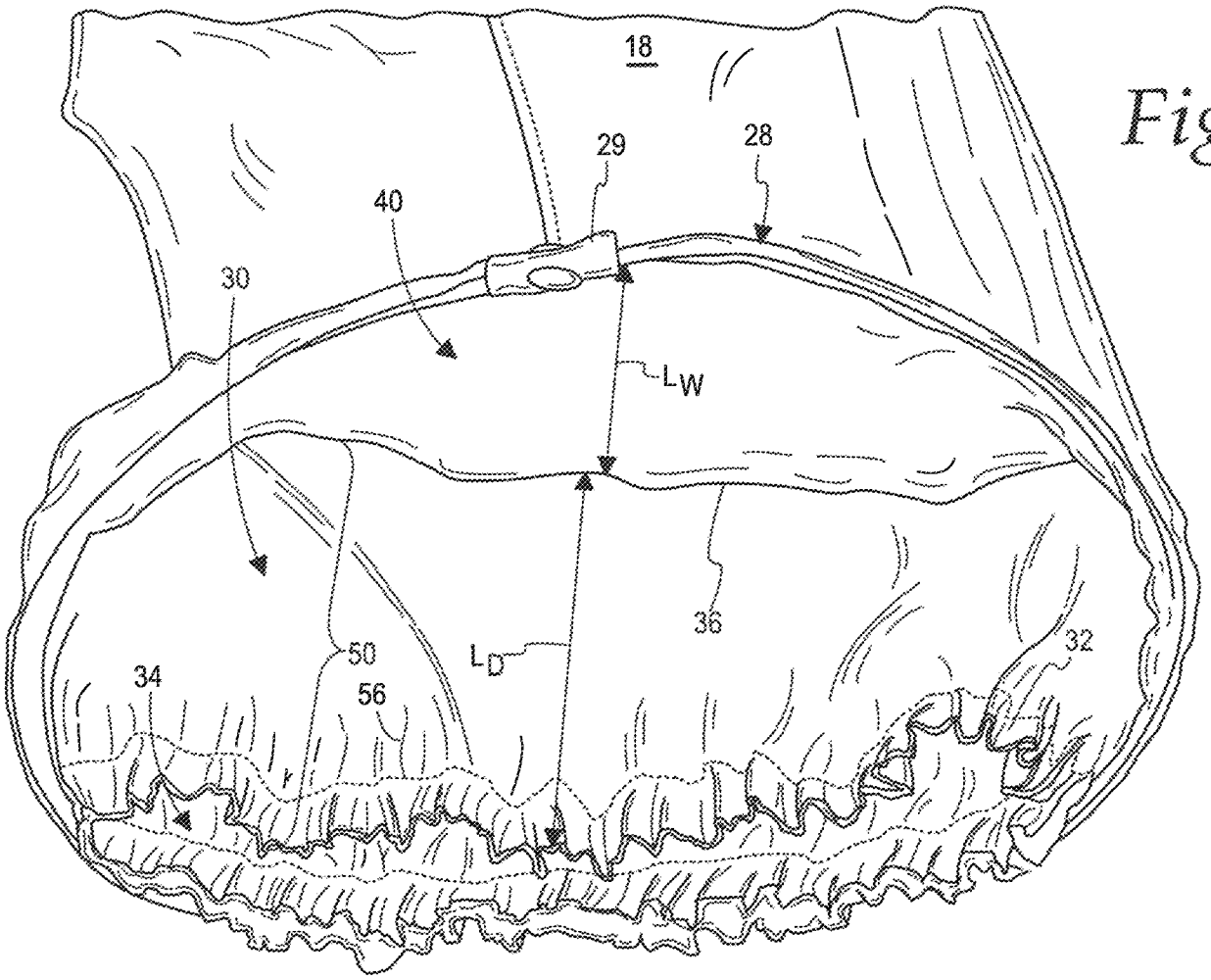
FIG. 5 is a view looking upwards into the bottom of the liner and cuff.
Figure 6:
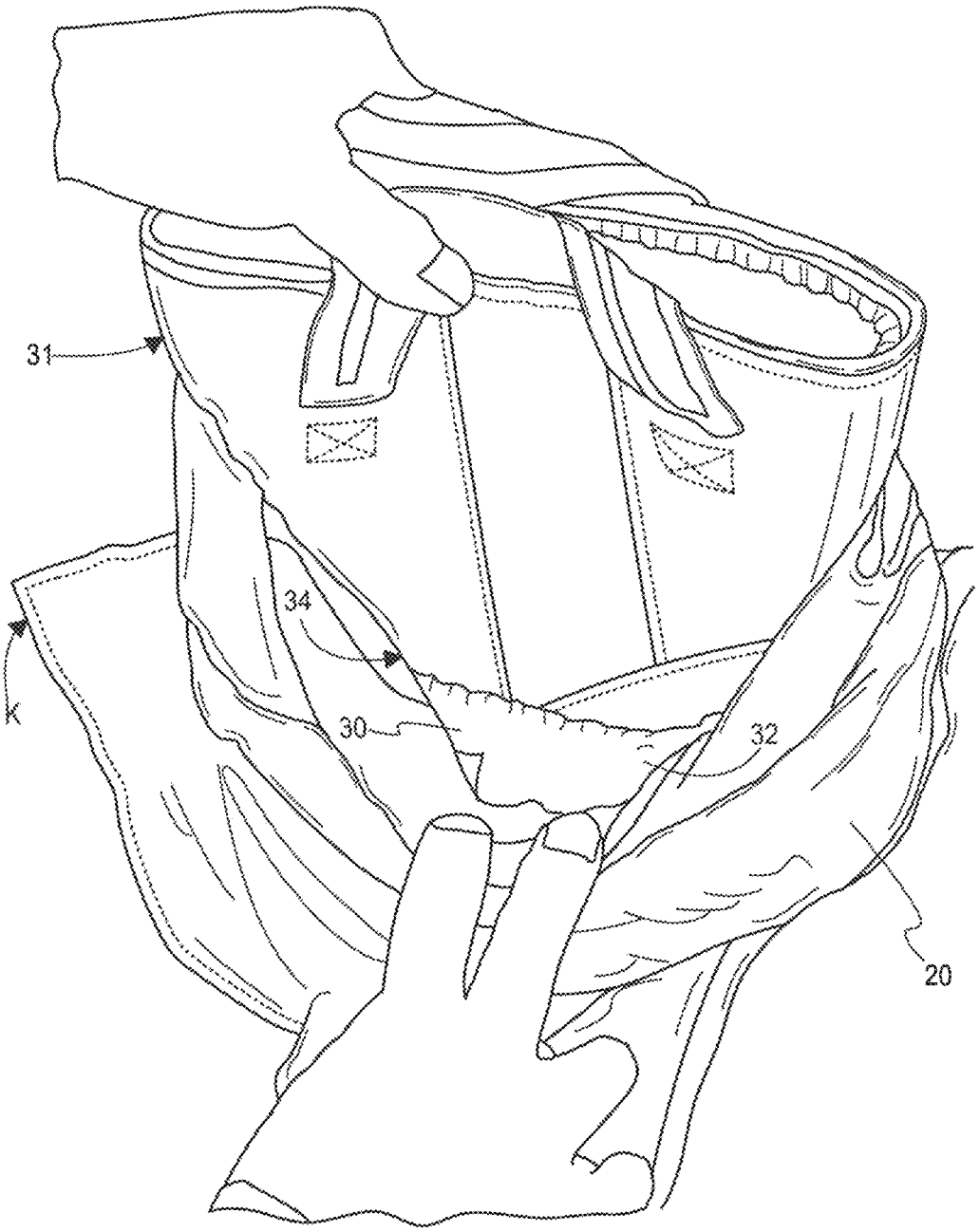
FIG. 6 is a view from above showing the inside of the liner and a portion of the cuff engaged with the shaft of the boot in the up position.

In the illustrated embodiment, the protective cuff 16 includes a fluid/particulate/water dam 30 that surrounds a shaft 31 of the boot 11 and is attached to the inside of the liner 14 at a location that is 2 inches or more above the hem 28 so that a seal forming, elasticized or O-ringed gathering 32 defining a circumferential opening 34 of the water dam 30 can more effectively wrap/fit around and engage the shaft 31 of the boot 11, instead of being limited to the smaller and tougher to seal ankle of the boot/wearer. In this regard, the water dam 30 is attached to the thermal liner 20 by a circumferential line of stitching 36 that extends around the interior circumference of the liner 14, typically parallel to the hem 28 at a location that is at least 2 inches above the hem 28. In most applications, it will be desirable for each stitch of the stitching 36 to extend only through the thermal barrier 20 and not into the moisture barrier 18, as best seen in FIGS. 1 and 2. By attaching the water dam 30 at the illustrated location, the gathered opening 34 can inherently engage the boot 11 at a location that is higher from any surface on which a wearer is standing, which provides greater protection from contamination by water or other liquids that may have pooled at a level above the surface.

Additionally, in the illustrated embodiment, the protective cuff 16 includes an anti-wicking cover or guard 40 that also surrounds the shaft 31 and extends continuously downward from the water dam 30 and the stitching 36 to the hem 28 of the liner 14 so as to cover the inside of thermal barrier 20 that would otherwise be exposed. It should be appreciated that the anti-wicking guard 40 will have a length $L_W$ that is at least 2 inches because the stitching 36 is located at least 2 inches above the hem 28. In most applications it will be desirable to use a single piece of material to form both the water dam 30 and the anti-wicking guard 40 of the cuff 16. However, in some applications it may be desirable to form the cuff 16 from two or more pieces of material.

As best seen in FIG. 2, in the illustrated embodiment, the bottommost portions 42 and 44, respectively, of the moisture barrier 18 and thermal barrier 20 are folded upward at the hem 28 with the bottommost portion 46 of the anti-wicking cover 40 also folded upward and around the upward folded portion 44 of the thermal barrier 20 so that it extends between the upward folded portion 42 of the moisture barrier 18 and the upward folded portion 44 of the thermal barrier 20 at the hem 28. One or more lines of stitching 48 can be used to join the upward folded portions at the hem 28. This construction is advantageous because it allows the anti-wicking cover 40 to protect the thermal barrier 20 even within the hem 28 of the liner 14.

As used herein, it should be recognized that references to bottom, bottommost, upward, etc. refer to the orientation of components as most commonly oriented. For example, pant legs and arm sleeves are typically oriented with their opening from which the wearer's feet and hands exit the garment being at the bottom of the legs/sleeves, though sometimes a wearer may extend his arms (and thus the sleeves) upwardly and, similarly, a wearer may occasionally be inverted so that the pant leg cuff is at the top of the pant leg. While such orientations might thus alternatively be identified as having a pant cuff at its outermost end, with the folded portion 44 folded inwardly, bottom, up, etc. is used herein to avoid confusion with "outer" and "inner" as it is conventionally used in the field to describe the relative orientations of the (outer) shell 12 and (inner) liner 14.

In the illustrated embodiment, the length $L_D$ of the fluid/particulate/water dam 30 from the gathered opening 34 to where it is attached by the stitching 36 to the inner circumference of the liner 14 is 2 inches or more so that there is loose material 50 between the stitching 36 and the gathered opening 34 that can allow the gathered opening 34 to remain in substantially the same place on the shaft 31 while allowing the pant shell 12 and/or liner 11 to freely telescope up and down with the movement of a wearer's legs while climbing, crawling, squatting, etc. The range of relative motion of the dam 30 is illustrated by a comparison of FIGS. 1 and 2, with FIG. 1 showing the dam 30 in an "up position" and FIG. 2 showing the dam 30 in a "down position" wherein the outer shell 12 and liner 14 have been drawn upwards which results in the gathering 32 and opening 34 being positioned adjacent the hem 28 rather than several inches above the hem 28. The illustrated embodiment provides the range of motion of at least about 4 inches. This allows the gathered opening 34 to create and maintain better and more continuous contact with the boot shaft 31 which will further reduce the entrance of fluids, airborne particulates, and/or contaminates. In this regard, it should be understood that it will be advantageous for a wearer to don the pant/liner combination 10 so that the gathered opening 34 is in the up position shown in FIG. 1. However, it should be understood that it is possible for a user to don the pant/liner combination with the gathered opening shown in the down position shown in FIG. 2, which would result in the gathered opening 34 being engaged with the ankle of the boot 11 rather than the shaft 31, and with any subsequent bending of the wearer's leg resulting in the gathered opening 34 being moved upwards on the shaft 31 where the gathered opening would remain after the wearer's leg is unbent.

While any suitable construction, many of which are known, can be used for the gathered opening 34, in the illustrated embodiment, the gathered opening 34 is created by folding the uppermost portion 52 of the material of the water dam 40 inwardly around a resilient ring 54 that is formed from either a resilient O-ring or a ring of elastic material, and then by providing a line of stitching 56 to form the gathered hem 32 at the opening 34.

Adding the anti-wicking guard 40 for the inner surface of the liner 14 between the liner hem 28 and the stitching line 36 of the dam 30 will provide further protection from fluid and/or airborne contaminants from saturating inner material of the thermal barrier 20, an advantage being no additional weight gain from fluid retention and less residual contamination of TICs and VOCs. In many applications it will be desirable for the anti-wicking guard 40 to be a continuous extension off the end of the fluid/particulate dam's stitching line 36 and down to the hem 28, however it could also be cut from two materials such that the dam 30 acts as only a particulate filter while the anti-wicking cover 40 also offers hydrostatic water/fluid resistance. While in most applications it will be advantageous for the protective cuff 16 to include the anti-wicking guard 40, it should be understood that in some applications it may be desirable for the protective cuff 16 to include only the water dam 30.

As discussed above, both the length $L_W$ and $L_D$ are at least 2 inches in the illustrated embodiment and it has been determined that in most applications such dimensioning will be advantageous. Additionally, it has been determined that lengths of about 3 inches for $L_W$ and $L_D$ will be highly advantageous in many applications, with a ±⅛ inch or ¼ inch variation in the 3 inch length also being highly desirable. Having noted the above, it has also been determined that lengths longer than 3 inches may also prove advantageous depending upon the particular application and the particular construction of the protective garment in which the cuff 16 is incorporated. It should be understood that there is no requirement that the lengths $L_W$ and $L_D$ be equal to each other, but in many applications it may be advantageous for the lengths to be within an ⅛ inch or ¼ inch of being equal.

One suitable material used for forming the fluid/particulate dam 30 and anti-wick guard 40 would be one that blocks particulates and also passes hydrostatic pressure equal to or greater than the requirements for the rest of the garment. However in certain cases it would be suitable to use a breathable yet proven/tested particulate filtering material would create a "Particulate Filtering Dam Only" that would reduce the entry of airborne particulates as well as droplets of liquid splash (though it might still wick liquids when it is in direct contact with them).

While the illustrated embodiment of the protective cuff 16 will be advantageous in many applications, it should be understood that different embodiments would be suitable for other versions and other applications. For example, the gathered opening 34 could be utilized to engaged the calf of a wearer, rather than the shaft 31 of a protective boot 11. Furthermore, the protective cuff 16 could be incorporated with the inner surface of an outer shell 12, rather than the inner surface of the liner 14. By way of further example, the protective cuff 16 could be utilized with the sleeve of a protective coat, again either integrated with the outer shell of such a sleeve or the inner liner of such a sleeve, with the gathered opening 34 being utilized to engage a glove or the arm of a wearer.

It should be appreciated that the protective cuff 16 provides an improved fluid and/or particulate dam 30 that operate more effectively in comparison to currently available designs; combining the attributes of an anti-wicking guard and a fluid/particulate/water dam, such that they complement each other and are provided as a more effective, single feature than heretofore accomplished. This eliminates the variations and combinations of conventional wicking guards and fluid/particulate/water dams with a single unitary design that improves quality, and minimizes the possibility of wearer error in selecting appropriate components, and simplifies the manufacturing process by reducing part count and the number of possible variations and combinations required for the manufacturing of appropriate protective garments. It should further be appreciated that the protective cuff 16 disclosed herein introduces a third unique attribute for the boot-to-pant interface area, namely an effective telescoping effect that allows the fluid/particulate dam 30 to act like an accordion to reduce or eliminate restriction of motion that was inherit in prior art designs.

The invention claimed is:

1. A protective garment comprising:

a pant leg configured to circumferentially engage a leg of a wearer; and a protective cuff fixed in the pant leg of the protective garment, the protective cuff comprising:

a fluid/particulate/water dam disposed about an interior circumference of the pant leg at an attachment location that is spaced upwardly between 2.75 inches and 3.25 inches from a lowermost hem of the pant leg, the fluid/particulate/water dam being configured to reduce or prevent fluids and particulates from passing into the pant leg, the barrier comprising:

a resilient opening configured to surround and snuggly engage a lower portion or a middle portion of a shaft of a boot at a location higher than a heel of the boot when the protective garment and boot are worn by a user, and a length of loose material coupled at a first end to the resilient opening, extending between 2.75 inches and 3.25 inches from the resilient opening to the attachment location, and coupled at a second end to the attachment location, the length of loose material being configured to surround an upper portion of the shaft of the boot when the boot is slidably disposed through the resilient opening; and an anti-wicking guard extending from the lowermost hem to the attachment location and surrounding the interior of the pant leg, wherein the anti-wicking guard includes a portion that extends upwardly between the water barrier and the thermal barrier at the lowermost hem.

2. The protective garment of claim 1 wherein the dam and the anti-wicking guard are formed by the same piece of material.

3. The protective garment of claim 1 wherein the pant leg is provided in the form of a liner having an outwardly facing moisture barrier and an inwardly facing thermal barrier, and the fluid/particulate/water dam is fixed only to the thermal barrier at the attachment location.

4. The protective garment of claim 3 further comprising:

one or more circumferential lines of stitching extending about an interior circumference of the liner and extending through the thermal barrier but not the moisture barrier, such that the moisture barrier protects the thermal barrier, including a portion of the thermal barrier within the lowermost hem of the pant leg.

5. The protective garment of claim 1 wherein the resilient opening comprises an elastic o-ring surrounded by a portion of the length of loose material.

6. The protective garment of claim 1 wherein the length of loose material provides for a range of motion of at least 4 inches without causing movement of the resilient opening with regard to the shaft of the boot.

* * * * *